US007268290B2

(12) United States Patent
Parsons et al.

(10) Patent No.: US 7,268,290 B2
(45) Date of Patent: Sep. 11, 2007

(54) TACTILE METRONOME

(75) Inventors: Christopher V. Parsons, San Antonio, TX (US); David M. Tumey, Crestview, FL (US)

(73) Assignee: Solutions for Thought, LLC, San Antonio, TX (US)

( * ) Notice: Subject to any disclaimer, the term of this patent is extended or adjusted under 35 U.S.C. 154(b) by 91 days.

(21) Appl. No.: 11/138,750

(22) Filed: May 26, 2005

(65) Prior Publication Data

US 2007/0119294 A1 May 31, 2007

Related U.S. Application Data

(63) Continuation-in-part of application No. PCT/US03/23633, filed on Jul. 29, 2003, which is a continuation of application No. 10/306,263, filed on Nov. 27, 2002, now abandoned.

(51) Int. Cl.
*G10H 3/00* (2006.01)

(52) U.S. Cl. ..... 84/723; 84/725; 84/730; 84/735; 84/600

(58) Field of Classification Search ..... None
See application file for complete search history.

(56) References Cited

U.S. PATENT DOCUMENTS

| | | | | |
|---|---|---|---|---|
| 1,425,523 | A | 8/1922 | Hammond, Jr. | |
| 3,467,959 | A | 9/1969 | Zazofsky | |
| 3,595,122 | A | 7/1971 | Brediceanu | |
| 3,991,648 | A | 11/1976 | Karpowicz | |
| D249,936 | S | 10/1978 | Ishida | |
| 4,462,297 | A | 7/1984 | Dill et al. | |
| 4,559,929 | A | 12/1985 | Hseu | |
| 4,570,616 | A | 2/1986 | Kunz et al. | |
| 5,054,361 | A | 10/1991 | Usa | |
| 5,515,764 | A | 5/1996 | Rosen | |
| 5,581,484 | A | 12/1996 | Prince | |
| 5,959,230 | A | 9/1999 | Fulford | |
| 6,040,517 | A | 3/2000 | Sakamoto | |
| 6,090,037 | A * | 7/2000 | Gavish | 600/27 |
| 6,102,875 | A | 8/2000 | Jones | |
| 6,217,533 | B1 | 4/2001 | McCambridge | |
| 6,432,072 | B1 | 8/2002 | Harris et al. | |
| 6,461,377 | B1 | 10/2002 | An | |
| 6,653,545 | B2 | 11/2003 | Redmann et al. | |
| 6,714,123 | B1 | 3/2004 | Miyake et al. | |
| D488,078 | S | 4/2004 | Nakakjima et al. | |
| 6,737,572 | B1 | 5/2004 | Jameson et al. | |

(Continued)

FOREIGN PATENT DOCUMENTS

| | | |
|---|---|---|
| EP | 1 523 163 | 4/2005 |

(Continued)

*Primary Examiner*—Marlon Fletcher
(74) *Attorney, Agent, or Firm*—Gunn & Lee, P.C.

(57) ABSTRACT

A tactile metronome for use by a musician generally includes a signal generator for producing an electrical signal according to a desired timing scheme and a tactile transducer in electrical communication with the signal generator. The tactile transducer, which may take the form of a piezoelectric device, a buzzer, electrodes or any substantial equivalent, is adapted to impart a tactile sensation to the musician in response to the generated electrical signal. A strap, which may be formed from an elastic material or a soft cloth material with hook and loop fasteners, is provided to secure the tactile transducer in place on the musician's body.

23 Claims, 5 Drawing Sheets

U.S. PATENT DOCUMENTS

| | | | | |
|---|---|---|---|---|
| 6,774,297 | B1 | 8/2004 | Lee | |
| 6,850,150 | B1 | 2/2005 | Ronkainen | |
| 6,850,782 | B2 | 2/2005 | Bright et al. | |
| 2002/0149561 | A1 | 10/2002 | Fukumoto et al. | |
| 2002/0165921 | A1 | 11/2002 | Sapieyevski | |
| 2003/0003976 | A1 | 1/2003 | Mura | |
| 2003/0024375 | A1 | 2/2003 | Sitrick | |
| 2003/0236101 | A1 | 12/2003 | Kemppinen | |
| 2004/0067780 | A1 | 4/2004 | Eiden | |
| 2004/0077934 | A1* | 4/2004 | Massad | 600/300 |
| 2004/0079220 | A1 | 4/2004 | Yagi | |
| 2004/0099132 | A1 | 5/2004 | Parsons | |
| 2004/0100366 | A1 | 5/2004 | Parsons | |
| 2004/0168565 | A1 | 9/2004 | Nagao et al. | |
| 2004/0255756 | A1 | 12/2004 | Nagakura | |
| 2005/0064912 | A1 | 3/2005 | Yang et al. | |
| 2005/0275508 | A1 | 12/2005 | Orr et al. | |
| 2006/0102171 | A1* | 5/2006 | Gavish | 128/95.1 |

FOREIGN PATENT DOCUMENTS

| | | |
|---|---|---|
| EP | 1 600 907 | 11/2005 |
| JP | 58113779 | 7/1983 |
| JP | 10 248192 | 9/1998 |
| JP | 2001154672 | 6/2001 |
| JP | 2001 259134 | 9/2001 |
| JP | 2002261637 | 9/2002 |
| JP | 2003 145049 | 5/2003 |
| JP | 2004 113944 | 4/2004 |
| JP | 2004205483 | 7/2004 |
| JP | 2004317404 | 11/2004 |
| WO | WO 03/052528 | 6/2003 |
| WO | WO 03/062930 | 7/2003 |
| WO | WO 03/105313 | 12/2003 |

* cited by examiner

TACTILE METRONOME

RELATED APPLICATIONS

This application claims priority, under 35 U.S.C. § 120 as a continuation-in-part, to P.C.T. international application Serial No. PCT/US03/23633 filed Jul. 29, 2003 and designating the United States, which is a continuation of U.S. patent application Ser. No. 10/306,263 filed Nov. 27, 2002 now abandoned. By this reference the full disclosures, including the drawings, of P.C.T international application Serial No. PCT/US03/23633 and U.S. patent application Ser. No. 10/306,263 are incorporated herein as though now set forth in their respective entireties. Additionally, the full disclosure, including the drawings, of Applicant's co-pending U.S. patent application entitled VIBRATING TRANSDUCER WITH PROVISION FOR EASILY DIFFERNTIATED MULTIPLE TACTILE STIMULATIONS filed May 26, 2005 in the name of David M. Tumey is incorporated herein as though now set forth in its entirety.

FIELD OF THE INVENTION

The present invention relates to music technology. More particularly, the invention relates to a metronome with provision for communication with a musician through tactile stimulation and being particularly adapted for the generation and communication of complex rhythmic patterns and measure timing, e.g., the timing of downbeats, in addition to being adapted to the communication of variable tempos.

BACKGROUND OF THE INVENTION

The metronome is well established as a fundamental tool of musical education. Having been developed before the advent of the electrical apparatus, the traditional metronome comprises a mechanical assembly adapted to generate a clicking sound at a desired beat frequency. With the advent of modern electronics a very precise audio output may now be produced or, as is particularly useful for the musical education of deaf persons, the output signal from the metronome may be communicated with a visual indicator such as a flashing light.

While the improvements made possible through technology are meritorious, Applicant has discovered that the improvements generally serve only to better implement a fundamentally flawed method. In particular, Applicant has noted that the audio nature of the metronome, which is apparently a holdover from the days of primitive technology, is distracting to the musician and, in at least some musical environments, ineffective due to the inability of the musician to clearly hear the audio signal. Additionally, the audio signal is wholly inappropriate for use by the hearing impaired. While this latter issue has been at least addressed through metronomes with visual outputs, it is noted that the use of the visual indicator mandates that the musician completely memorizes his or her music.

It is therefore an overriding object of the present invention to improve over the prior art by providing a metronome that is free of the foregoing flaws. In particular, it is an object of the present invention to provide a metronome having a tactile output such that the musician may feel the desired beat regardless of the volume of the performance or a particular user's physical limitations. Additionally, it is an object of the present invention to provide such a metronome that also may be programmed to provide enhanced capabilities such as, for example, complex output rhythms and/or tactile stimulation designed for the development of articulation. Finally, it is an object of the present invention to provide such a metronome that is also economical to produce and easy to use.

SUMMARY OF THE INVENTION

In accordance with the foregoing objects, the present invention—a tactile metronome for use by a musician—generally comprises a signal generator for producing an electrical signal according to a desired timing scheme and a tactile transducer in electrical communication with the signal generator. The tactile transducer, which may comprise a piezoelectric device, a buzzer, electrodes, a bone density resonator, an electrical stimulation device, a mechanical transducer, an eccentric motion generator or any substantial equivalent, is adapted to impart a tactile sensation to the musician in response to the generated electrical signal. A strap, which may comprise an elastic material or a soft cloth material with hook and loop fasteners, is preferably provided to secure the tactile transducer in place on the musician's body.

In at least one embodiment, the signal generator is adapted to produce complex rhythms and may be programmable such that the musician may define the complex rhythm. In this embodiment, the signal generator preferably further comprises a micro-controller.

In at least one embodiment of the present invention, a vibrating transducer for producing multiple, readily differentiable tactile stimulations is provided. In the preferred embodiment of the present invention, the vibrating transducer generally comprises a rigid housing; an electric motor enclosed within the rigid housing and having attached thereto an eccentric weight; and wherein the electric motor is supported within the rigid housing by a flexible motor mount. The rigid housing comprises a generally cylindrically shaped tube.

The flexible motor mount may be formed of a cushion, which may be made from foam material or the like. In at least one embodiment of the present invention, the cushion is wrapped substantially about the electric motor, centering the electric motor within the cylindrically shaped tube forming the rigid housing. In order to facilitate manufacture of the vibrating transducer of the present invention, the cushion may be wrapped by a securing sheet such as, for example, a thin paper wrapping, a length of adhesive tape or the like.

In a further embodiment of the vibrating transducer of the present invention, a driver circuit may be provided for facilitating operation of the electric motor. The driver circuit may include a current amplifier.

A display, such as a liquid crystal display or a light emitting diode display, is provided to facilitate selection of the desired output frequency or rhythmic pattern. Likewise, a user interface is provided for input of rhythmic patterns, operational control and the like.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
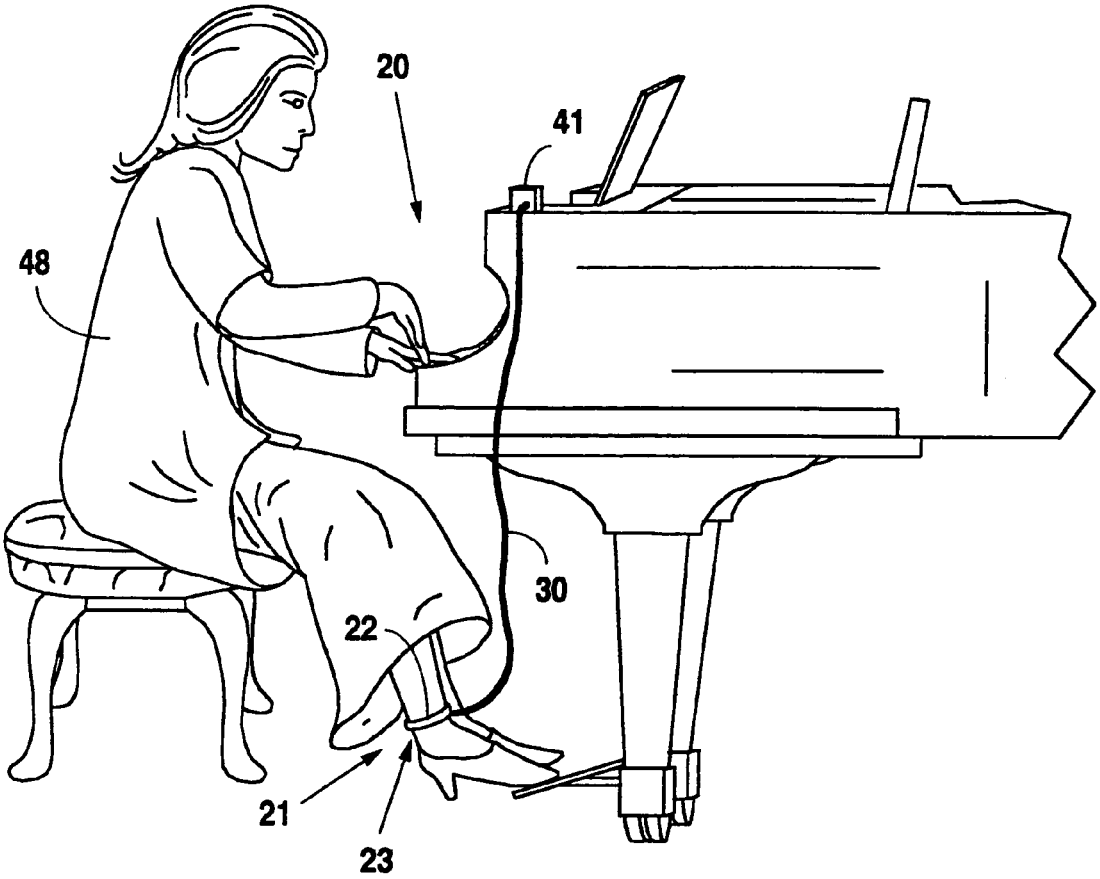
FIG. 1 shows, in a perspective view, one embodiment of the tactile metronome of the present invention as operably employed by a musician.
Figure 2:
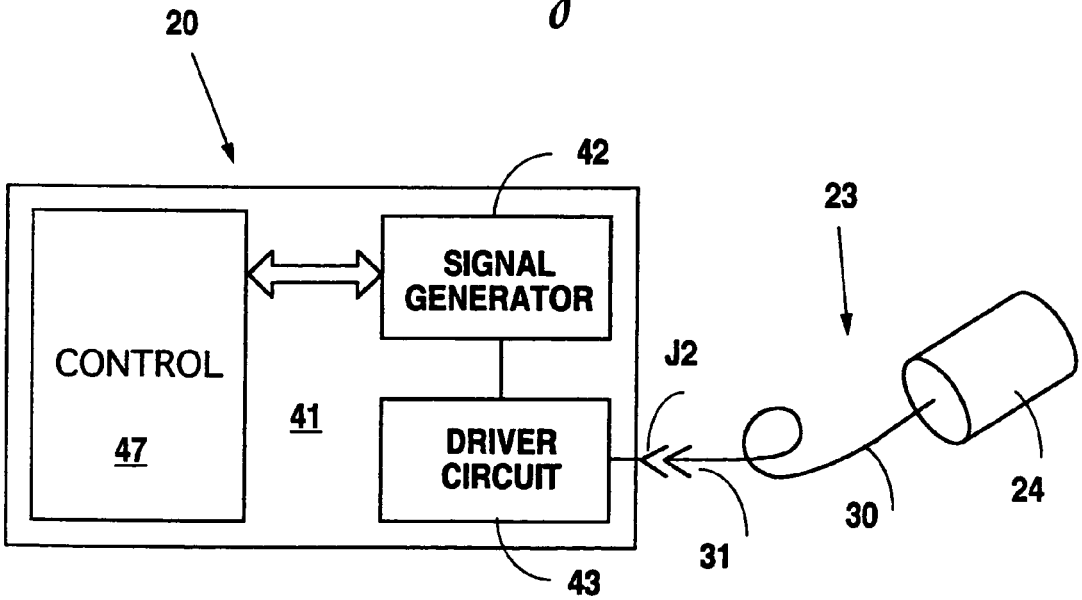
FIG. 2 shows, in a functional block diagram, the preferred embodiment of the tactile metronome of the present invention.

Referring now to the FIGS. 1 and 2, the tactile metronome 20 of the present invention is shown to generally comprise a signal source 41 in electrical communication with a contact device 21 comprising, at minimum, a tactile transducer 23 and which, as will be better understood further herein, is adapted to impart to a user 48 a tactile stimulation. As particularly shown in FIG. 2, the signal source 41 preferably comprises a signal generator 42, for generating an electrical signal for delivery to the tactile transducer 23, the generated electrical signal having electrical characteristics indicative of user selected measure (or downbeat) timing, tempo and rhythmic pattern, and a controller 47 for facilitating user selection of the characteristics of the signal generated by the signal generator 42. A display, which may comprise a liquid crystal display, light emitting diode display or any other substantially equivalent structure, and a user input system, which may comprise a touch screen control, computer interface such as a USB port, wireless interface or the like, or buttons or dials, are also preferably provided in connection with the controller 47 for use inputting and monitoring user selections.

As particularly shown in FIG. 1, the contact device 21, which is preferably adapted for wear on the user's ankle, wrist, chest, spinal region or other appropriate location, generally comprises a strap 22 of soft cloth and/or elastic material having a tactile transducer 23 affixed to an interior side thereof. The strap 22 may comprise releasably engageable hook and loop type fasteners, such as are commercially available under the well-known trademark "VELCRO," or any other substantially equivalent fastener system, for snuggly securing the strap 22 about the user's ankle, wrist, chest, spinal region or other location. In this manner, those of ordinary skill in the art will appreciate that the strap 22 is adapted to facilitate intimate contact between the tactile transducer 23, which may comprise a piezoelectric device, buzzer, pair of electrodes, a bone density resonator, an electrical stimulation device, a mechanical transducer, an eccentric motion generator or any other substantially equivalent structure capable of imparting the desired tactile stimulation, and the user's body. Additionally, an electrical cable or power cord 30, which preferably terminates in a standard plug 31, enabling the signal source 41 of the present invention to be utilized with any of a variety of tactile transducers 23, provides electrical communication between the contact device 21 and an output jack from the signal source 41.

In use, as particularly shown in FIG. 1, a musician 48 affixes the tactile transducer 23 in a minimally obtrusive location utilizing the strap 22. The musician 48 then connects the electrical cable 30 between the contact device 21 and the signal source 41 by inserting the standard plug 31 into the output jack of the signal source 41. An output power level selector 45 is preferably provided, as described in more detail further herein, to adjust the "feel" of the tactile metronome 20 of the present invention.

With the tactile transducer 23 positioned as desired, the musician 48 utilizes the provided control input and display to set the beats per minute and, if desired, rhythmic pattern, to be generated by the signal generator 42. To this end, those of ordinary skill in the art will recognize that the display should be adapted to provide a digital readout of the current setting. Additionally, however, it is contemplated by the present invention that the display may also be adapted to provide a graphical readout comprising a musical score, such as those shown in the upper portions of FIGS. 9 and 10, especially when the controller 47 is programmed to produce more complicated rhythms such as that depicted in FIG. 10. In any case, with the tactile metronome 20 of the present invention in proper position and set up as desired, the musician 48 may perform his or her musical instrument of choice while literally feeling the desired beat and without having to divert attention to listen to a traditional metronome or watch for flashing lights or the like.

As will be appreciated by those of ordinary skill in the art, especially in light of this exemplary description, the controller 47 may be readily provided with a timing circuit or programmed to provide complex beat patterns. In such an embodiment, a communication interface or other programming input as well as read only or non-volatile random access memory are preferably provided for the signal source 41 such that the musician 48 may input and/or select a desired beat pattern. In one such embodiment, as will be discussed in further detail herein, an electronic score may be programmed into the controller, either directly or through a computer or PDA interface, whereafter the user need only select desired tempo and starting point to have the tactile metronome 20 of the present invention produce rhythmic stimulation for literally a complete musical selection.

Referring now to the FIGS. 3 through 7 in particular, a preferred embodiment of the tactile transducer 23 is shown to comprise a vibrating transducer 24 having the unique ability to produce multiple easily differentiated tactile stimulations. As shown in the figures, such a vibrating transducer 24 generally comprises an electric motor 28 having attached thereto an eccentric weight 33 and encased within a rigid housing 25. As is typical with pager transducers and the like, operation of the electric motor 28 turns a shaft 34 upon which the eccentric weight 33 is mounted with, for example, a pin 35. As will be appreciated by those of ordinary skill in the art, rotation upon the shaft 34 of the eccentric weight 33 produces a vibratory effect upon the motor 28 resulting from the forward portion 32 of the motor 28 attempting to shift laterally outward from the nominal axis 36 of rotation of the shaft 34, as depicted by the centrifugal force lines F in FIG. 6.

In typical implementations of this principle, the electric motor is rigidly fixed to some body such as, for example, a pager or cellular telephone housing with mounting clamps, brackets or the like. In the present implementation, however, unlike the vibrating transducers of the prior art, the electric motor 28 is encased within a rigid housing 25 by the provision of a flexible motor mount 37, which allows the forward portion 32 of the electric motor 28 to generally wobble within the rigid housing 25 as the eccentric weight 33 is rotated upon the motor shaft 34. In this manner, the resultant forces F are the product of much greater momentum in the eccentric weight 33 than that obtained in the fixed configuration of the prior art.

Figure 3:
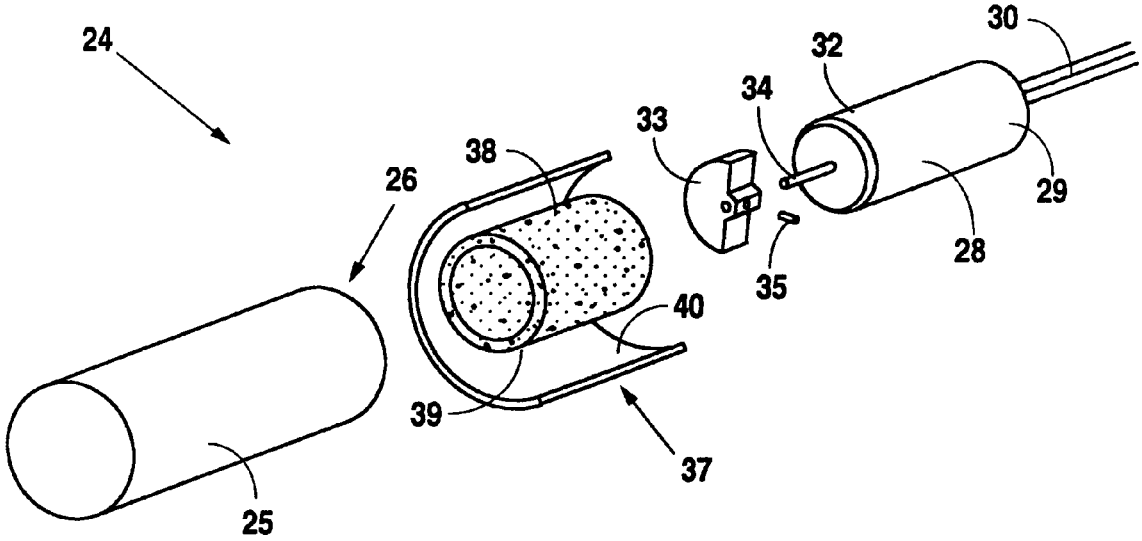
FIG. 3 shows, in an exploded perspective view, the preferred embodiment of a vibrating transducer as has been found to be optimum for use with the tactile metronome of FIG. 2.
Figure 4:
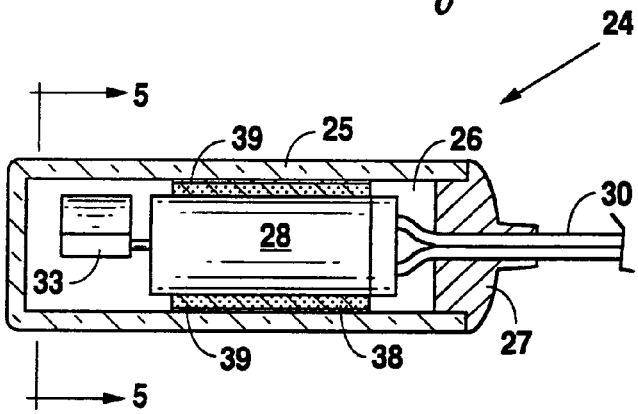
FIG. 4 shows, in a cross sectional side view, details of the arrangement of the internal components of the vibrating transducer of FIG. 3.

In the preferred implementation, as particularly detailed in FIGS. 3 through 6, the flexible motor mount 37 generally comprises a wrapping of preferably foam cushion material 38, which is sized and shaped to snuggly fill the space provided between the electric motor 28 and the interior of the rigid housing 25. To facilitate manufacture of the vibrating transducer 24, as generally depicted in FIG. 3, the foam cushion 38 may be held in place about the body of the electric motor 28 with a cushion securing sheet 40, which may comprise a thin paper glued in place about the cushion 38, thin adhesive tape or any substantially equivalent means. To complete the manufacture of the vibrating transducer 24, the cushioned electric motor 28, with eccentric weight 33 attached to its shaft 34, is inserted into the rigid housing 25 and secured in place by the application of epoxy 27 into the open, rear portion 26 of the housing 25. As will be understood by those of ordinary skill in the art, the epoxy 27 also serves to stabilize the power cord 30 to the electric motor 28, thereby preventing accidental disengagement of the power cord 30 from the electric motor 28.

Figure 5:
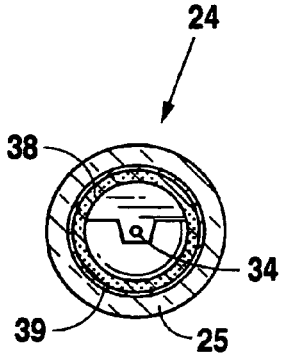
FIG. 5 shows, in a cross sectional end view taken through cut line 5-5 of FIG. 4, additional details of the arrangement of the internal components of the vibrating transducer of FIG. 3.
Figure 6:
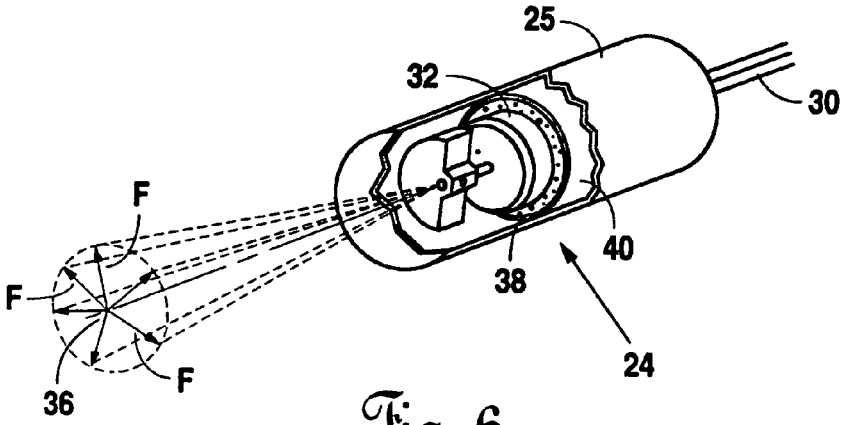
FIG. 6 shows, in a partially cut away perspective view, a representation of the forces produced in the operation of the vibrating transducer of FIG. 3.
Figure 7A:
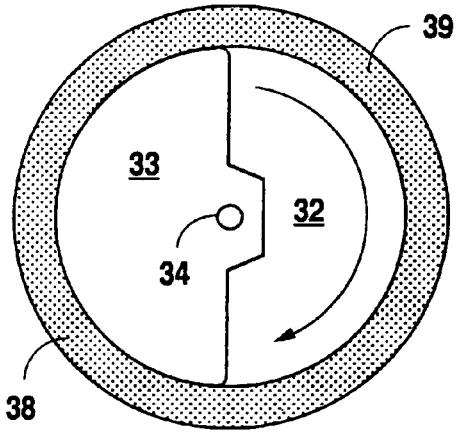
FIGS. 7A through 7F show, in schematic representations generally corresponding to the view of FIG. 5, changes in the relative positions of various internal components of the vibrating transducer of FIG. 3, which changes occur as a result of the operational forces represented in FIG. 6.
Figure 7B:
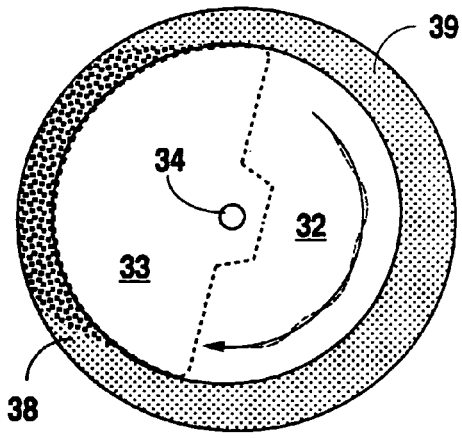
Figure 7C:
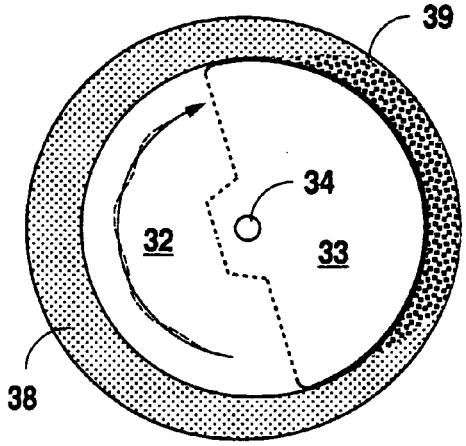
Figure 7D:
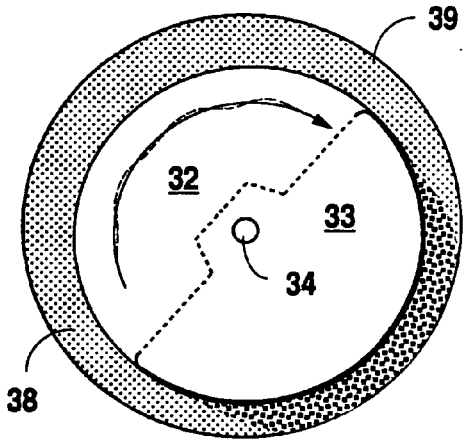
Figure 7E:
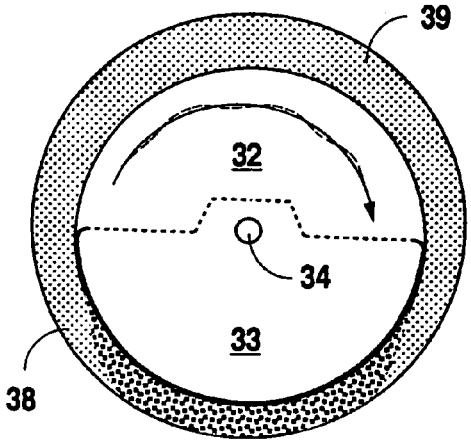
Figure 7F:
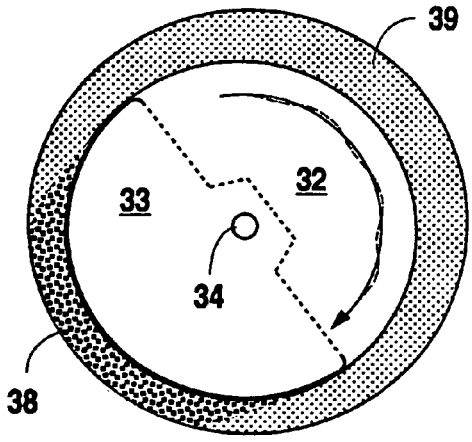

Referring now to FIGS. 5 through 7 in particular, the enhanced operation of the vibrating transducer 24 is detailed. At the outset, however, it is noted that in order to obtain maximum vibratory effect, the rigid housing 25 is provided in a generally cylindrical shape, as will be better understood further herein. In any case, as shown in the cross sectional view of FIG. 5, and corresponding views of FIGS. 7A through 7F, the forward portion 32 of the electric motor 28 is encompassed by the forward portion 39 of the foam cushion 38. At rest, i.e. without the electric motor 28 in operation, the electric motor 28 is substantially uniformly surrounded by the foam cushion 38, as shown in FIG. 7A.

Upon actuation of the electric motor 28, however, the centrifugal forces F generated by the outward throw of the eccentric weight 33 causes the axis of rotation 36 of the motor's shaft 34 to follow a conical pattern, as depicted in FIG. 6. As a result, the forward portion 32 of the electric motor 28 is thrown into the forward portion 39 of the foam cushion 38, depressing the area of cushion adjacent the eccentric weight 33 and allowing expansion of the portion of the cushion generally opposite, as depicted in FIGS. 7B through 7F corresponding to various rotational positions of the eccentric weight 33.

As is evident through reference to FIGS. 7B through 7F, the cooperative arrangement of the cushion 38 about the electric motor 28, as also enhanced by the cylindrical shape of the rigid housing 25, allows the eccentric weight 33 to build greater momentum than possible in embodiments where the motor is rigidly affixed to a body. As the forward portion 39 of the foam cushion 38 compresses under the centrifugal forces F of the eccentric weight 33, however, a point is reached where the foam cushion 38 is no longer compressible against the interior wall of the rigid housing 25 and the forward portion 32 of the electric motor 28 is repelled away from the interior wall toward the opposite portion of interior wall.

The result is a vibratory effect much more pronounced than that obtained in prior art configurations calling for the rigid affixation of an electric motor to a housing. Additionally, Applicant has found that the resulting pronounced vibratory effect is generally more perceptible to the human sense of touch than is that produced by prior art configurations. In particular, small differences on the order of tens of milliseconds or less in duration of operation of the vibrating transducer 20, i.e. duration of powering of the electric motor 28, are easily perceived and differentiated. As a result, this implementation of the vibrating transducer 24 is particularly adapted for implementation of the tactile metronome 20 of the present invention, which preferably comprises provision for distinct tactile stimuli representing downbeats versus divisional beats as well as the generation and communication of complex rhythms, which may require very quickly perceived stimulations with very little pause therebetween.

Figure 8:
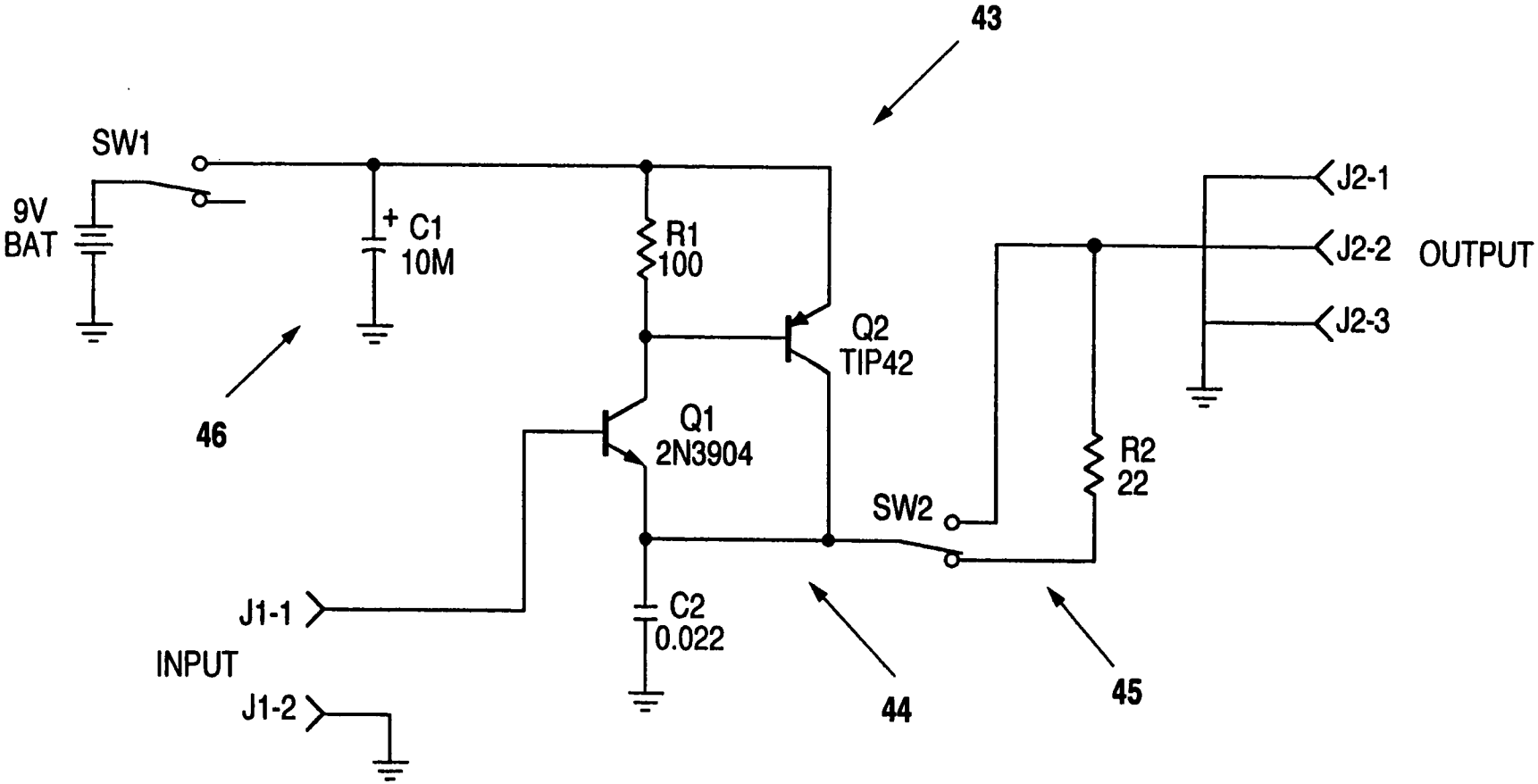
FIG. 8 shows, in a schematic diagram, details of one embodiment of a driver circuit, as depicted in FIG. 2, appropriate for operation of the vibrating transducer of FIG. 3.

As previously discussed, the signal source 41 of the tactile metronome 20 of present invention preferably comprises a driver circuit 43 for interfacing with the tactile transducer 23. In particular, as shown in FIG. 8, such a driver circuit 43 preferably comprises an output amplifier 44, which will generally be required for any implementation in which logical level signals will be expected to drive an electric motor such as is utilized in the preferred implementation of vibrating transducer 24. As will be appreciated by those of ordinary skill in the art, this requirement stems from the fact that such an electric motor 28 will generally have a current requirement beyond the capabilities of most solid state components. Additionally, in such implementations, the driver circuit 43 will also require implementation of a power conditioning circuit 46, as also shown in FIG. 8, having the capability to prevent and/or suppress voltage spiking, such as may be expected in response to the highly inductive load typical of the type of electric motor 28 utilized in the implementation of the vibrating transducer 24.

As shown in FIG. 8, an exemplary output amplifier 44, as is appropriate for use with the foregoing described vibrating transducer 24, comprises a 2N3904 NPN BJT transistor Q1, configured as an emitter follower, coupled with a TIP42 high current PNP transistor Q2 in a TO-220 heat dissipating package, for providing the necessary current for operation of the electric motor 28 of the vibrating transducer 24. As will be recognized by those of ordinary skill in the art, the output amplifier 44 as shown may be considered a two stage, high current emitter follower. The power conditioning circuit 46, which is preferably provided to prevent and/or suppress voltage spiking, such as may be expected in response to the highly inductive load typical of the type of electric motor 28 utilized in the implementation of the vibrating transducer 24 may be implemented by tying a 10 μF electrolytic capacitor C1 ground from the 9-V power bus from, for example, a 9-V battery BAT. As will be recognized by those of ordinary skill in the art, the electrolytic capacitor C1 will temporarily supply additional current to the 9-V bus as may be required to compensate for transients resulting from the draw upon the output amplifier 44 caused during startup of the electric motor 28 of the vibrating transducer 24. Additionally, the power conditioning circuit 46 preferably comprises an ON-OFF switch SW1 and may also include a power on indicator, if desired.

In order to adjust the "feel" of the tactile metronome 20 of the present invention, as previously discussed, the output from the output amplifier 44 is preferably fed through an output power level selector 45 to an output jack J2, into which the power cord plug 31 of the power cord 30 to the electric motor 28 of the vibrating transducer 24 may be operably inserted. As shown in FIG. 8, the output power level selector 45 preferably comprises a 22 Ω resistor R2, which is selectively placed in series with the output circuit by selecting the appropriate position of a single pole, single throw switch SW2. Although Applicant has found that 22 Ω is an appropriate value for the resistor R2, it is noted that the value is selected empirically in order to obtain the user desired tactile feel for the "low" output selection. Additionally, those of ordinary skill in the art will recognize that the resistor R2 may be replaced with a potentiometer, thereby providing a fully adjustable output power level.

Although the driver circuit 43 has been described as being integral with the signal source 41, it should be appreciated that the present invention contemplates that any necessary driver circuit 43 may be provided as part of the tactile transducer 23. In this manner, the signal source 41 may be utilized with virtually any type of tactile transducer 23, the driver circuit 43 being adapted to provide all necessary electrical compatibility between the chosen tactile transducer 23 and the signal source 41. In such an implementation, the driver circuit 43 should be provided with an input jack J1 for receiving signals from the signal generator 42.

Figure 9:
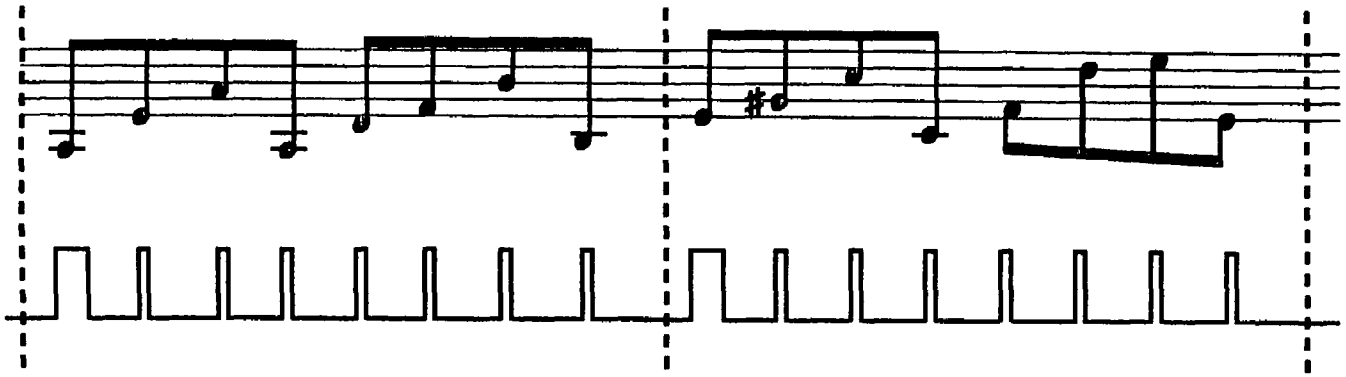
FIG. 9 shows, in a voltage waveform aligned with a musical score, a representative signal as may be generated by the signal generator of FIG. 2 for operation through the driver circuit of FIG. 2 of the vibrating transducer of FIG. 3, the waveform having characteristics such that the tempo and timing of measures of the score of FIG. 9 may be readily perceived by a musician employing the tactile metronome of the present invention in a manner such as depicted in FIG. 1.
Figure 10:
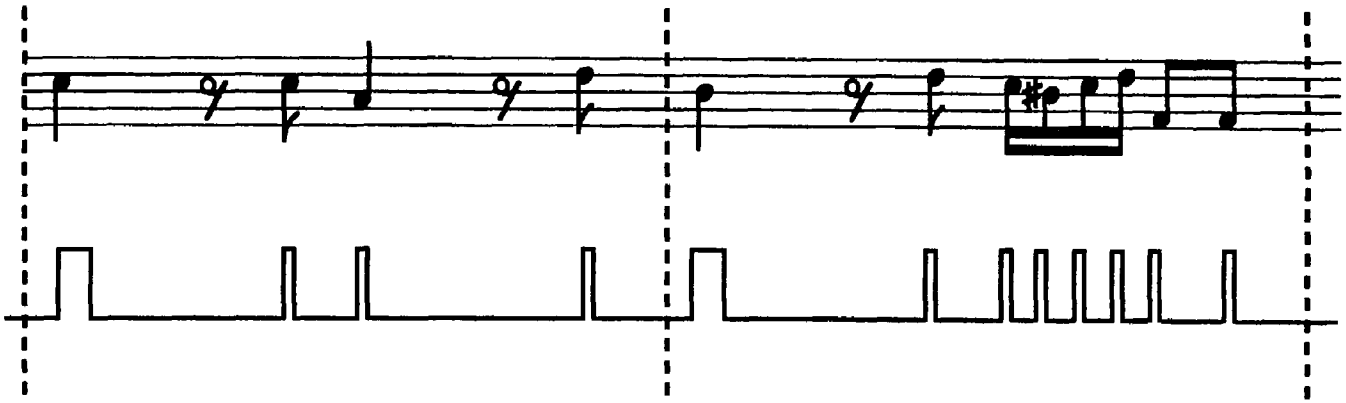
FIG. 10 shows, in a voltage waveform aligned with a musical score, a representative signal as may be generated by the signal generator of FIG. 2 for operation through the driver circuit of FIG. 2 of the vibrating transducer of FIG. 3, the waveform having characteristics such that the tempo and timing of measures, as well as the rhythm, of the score of FIG. 10 may be readily perceived by a musician employing the tactile metronome of the present invention in a manner such as depicted in FIG. 1.

In any case, as previously discussed, the tactile metronome 20 of the present invention is preferably adapted to impart to a musician 48 tactile stimulations indicative of tempo and measure timing, as shown in FIG. 9, as well as of tempo, measure timing and complex rhythmic patterns, as shown in FIG. 10. In particular, the preferred embodiment of the present invention contemplates imparting tempo information by the timing of the beginning of signal outputs from the signal generator 42. In order to differentiate downbeats, indicative of measure timing, the signal generator 42 is adapted under the control of the controller 47 to produce a signal output of longer duration than those indicative of divisional beats, the former of which will be noticeably perceived by the musician 48 as being of much greater intensity than the latter, especially when imparted through the foregoing described vibrating transducer 24. As shown in FIG. 9, the controller 47 is programmed to implement these aspects of the present invention by simply effecting at a set tempo a repeating pattern of output pulses from the signal generator 42 representing the downbeats and divisional beats.

As shown in FIG. 10, however, the tactile metronome 20 of the present invention is also preferably adapted to impart to a musician 48 tactile stimulations indicative of not only tempo and measure timing, but also complex rhythmic patterns. In this case, the controller 47 is preferably programmed to "follow" the score of a user chosen musical selection. In the alternative, however, the controller 47 may be pre-programmed with a plurality of rhythmic patterns, which may be simply selected through user input to the controller 47. As will be appreciated by those of ordinary skill in the art, the latter will have great utility in mastering basic rhythms. In any case, the preferred embodiment of the present invention contemplates that an appropriate programming interface be provided to allow the user to input to the controller 47 any desired rhythmic pattern or, for that matter, an entire musical score. As shown in FIG. 10, the controller 47 controls the signal generator 42 to produce output pulses only when the score calls for a note to be performed, giving greater duration, or intensity, to those pulses corresponding to downbeats.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. In any case, because the scope of the present invention is much broader than any particular embodiment, the foregoing detailed description should not be construed as a limitation of the scope of the present invention, which is limited only by the claims appended hereto.

What is claimed is:

1. A tactile metronome for use by a musician, said tactile metronome comprising:

a signal generator for producing an electrical signal according to a desired timing scheme that includes a complex beat pattern that are user definable, said timing scheme being produced by a controller;

a tactile transducer in electrical communication with said signal generator, said tactile transducer being adapted to impart a tactile stimulations to the musician corresponding to the complex beat pattern in response to said electrical signal; and a programming interface to said controller, said programming interface being adapted to enable the user to input a rhythmic pattern to said controller wherein said rhythmic pattern is programmable within the tactile metronome from user selected musical score within said programming interface.

2. The tactile metronome as recited in claim 1, said tactile metronome further comprising a strap, said strap being adapted to secure said tactile transducer in place on the musician's body.

3. The tactile metronome as recited in claim 2, wherein said strap comprises an elastic material.

4. The tactile metronome as recited in claim 2, wherein said strap comprises hook and loop fasteners for securing one edge of said strap to another.

5. The tactile metronome as recited in claim 1, wherein said complex beat pattern is user selectable.

6. The tactile metronome as recited in claim 5, wherein said rhythmic pattern comprises downbeats and said transducer is adapted to impart differentiable tactile stimulations corresponding to and indicative of said downbeats.

7. The tactile metronome as recited in claim 1, wherein said-tactile transducer comprises:

a rigid housing;

an electric motor enclosed within said rigid housing, said electric motor having attached thereto an eccentric weight; and wherein said electric motor is supported within said rigid housing by a motor mount that enables the electric motor, when energized, to wobble within the rigid housing so that the eccentric weight orbits about an elliptical path.

8. The tactile metronome as recited in claim 7, wherein said rigid housing comprises a generally cylindrically shaped tube.

9. The tactile metronome as recited in claim 1, wherein said controller is programmable by interface with a computer.

10. The metronome as recited in claim 9, wherein said computer comprises a personal computer.

11. The metronome as recited in claim 9, wherein said computer comprises a PDA.

12. The tactile metronome as recited in claim 1, wherein said tactile transducer is adapted to impart a tactile stimulation indicative of a sub-beat.

13. A metronome for use by musicians comprising:

a digital input device, including a digital display and a user interface, operable to enable a musician to define or select a beat pattern for use in practicing or performing music, said digital input device having therein pre-selected beat patterns for selection by said musicians;

a signal generator communicatively coupled to the digital input device, the signal generator being adapted to generate electrical signals in response to the defined or selected beat pattern;

a tactile transducer communicatively coupled to the signal generator and adapted to impart tactile stimulations to a musician corresponding to beats of the beat pattern defined or selected by the musician;

a first portable housing containing the signal generator;

a second portable housing containing the tactile transducer, the second portable housing being independent of and separate from the first portable housing; and an electrical cable connecting the signal generator to the transducer.

14. The metronome of claim 13, wherein the second portable housing is cylindrical in shape.

15. The metronome of claim 13, wherein the tactile transducer comprises:

an electric motor having a motor shaft carrying an eccentric weight; and a motor mount that enables the electric motor, when energized, to wobble within the second portable housing so that the eccentric weight orbits about an elliptical path.

16. The metronome of claim 13, said metronome further comprising a strap, said strap being adapted to secure said tactile transducer in place on the musician's body.

17. The metronome of claim 13, wherein said strap comprises hook and loop fasteners for securing one edge of said strap to another.

18. The metronome of claim 13, wherein said digital input device enables a musician to define or select a complex beat pattern for use in practicing or performing music.

19. The metronome of claim 13, wherein said tactile transducer is adapted to impart multiple, differentiable discrete, pulse-like tactile stimulations to a musician corresponding to different beats of the complex beat pattern.

20. A metronome for use by musicians comprising:

a digital input device, including a digital display and a user interface, operable to enable a musician to define or select a complex rhythm, including a tempo and varying note values, for use in practicing or performing music, said digital input device including complex rhythms stored therein from which said musician may select said complex rhythm;

a signal generator communicatively coupled to the digital input device, the signal generator being adapted to generate electrical signals in response to the defined or selected complex rhythm; and a tactile transducer communicatively coupled to the signal generator and adapted to impart multiple differentiable discrete, pulse-like tactile stimulations to a musician corresponding to varying note values of the complex rhythm defined or selected by the musician.

21. The metronome of claim 20, wherein the user interface enables the musician to independently define both the tempo and the note values of the complex rhythm.

22. The metronome of claim 20, further comprising:

a power supply for supplying power to the tactile transducer;

a first portable housing containing the power supply;

a second portable housing containing the tactile transducer, the second portable housing being independent of and separate from the first portable housing; and wires connecting the power supply to the transducer.

23. The metronome of claim 20, wherein the tactile transducer comprises:

an electric motor having a motor shaft carrying an eccentric weight; and a motor mount that enables the electric motor, when energized, to wobble within the second portable housing so that the eccentric weight orbits about an elliptical path.

* * * * *